US010848895B2

(12) United States Patent
Peeler et al.

(10) Patent No.: US 10,848,895 B2
(45) Date of Patent: Nov. 24, 2020

(54) CONTEXTUAL CENTER-OF-GRAVITY FOR AUDIO OUTPUT IN COLLABORATIVE ENVIRONMENTS

(71) Applicant: Dell Products, L.P., Round Rock, TX (US)

(72) Inventors: Douglas Jarrett Peeler, Austin, TX (US); Vivek Viswanathan Iyer, Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 16/243,864

(22) Filed: Jan. 9, 2019

(65) Prior Publication Data

US 2020/0221244 A1 Jul. 9, 2020

(51) Int. Cl.

| | |
|---|---|
| ***H04S 7/00*** | (2006.01) |
| ***H04R 5/02*** | (2006.01) |
| ***G10L 25/51*** | (2013.01) |
| ***G10L 25/78*** | (2013.01) |

(52) U.S. Cl.

CPC ..... *H04S 7/303* (2013.01); *G10L 25/51* (2013.01); *G10L 25/78* (2013.01); *H04R 5/02* (2013.01); *H04R 2499/15* (2013.01); *H04S 2400/13* (2013.01)

(58) Field of Classification Search

USPC ..... 381/1, 2, 12, 26, 56, 300, 303, 310

See application file for complete search history.

(56) References Cited

U.S. PATENT DOCUMENTS

| | | | | |
|---|---|---|---|---|
| 2009/0210271 | A1* | 8/2009 | Abrams | G06Q 10/101 709/205 |
| 2012/0230525 | A1* | 9/2012 | Higuchi | H04N 21/44218 381/303 |
| 2017/0212643 | A1* | 7/2017 | Stewart | G06F 3/0484 |
| 2018/0107440 | A1* | 4/2018 | Knoppert | G06F 3/0304 |

* cited by examiner

*Primary Examiner* — Yosef K Laekemariam
(74) *Attorney, Agent, or Firm* — Fogarty LLP

(57) ABSTRACT

Embodiments of systems and methods for using contextual center-of-gravity for outputting audio in collaborative environments are described. In some embodiments, an Information Handling System (IHS) may include: a processor; and a memory coupled to the processor, the memory having program instructions stored thereon that, upon execution by the processor, cause the IHS to: identify a first position of a first participant and a second position of a second participant during a collaboration session; calculate a Center-of-Gravity (CoG) based, at least in part, upon the first and second positions; and output audio during the collaboration session with a level determined based upon the CoG.

18 Claims, 7 Drawing Sheets

CONTEXTUAL CENTER-OF-GRAVITY FOR AUDIO OUTPUT IN COLLABORATIVE ENVIRONMENTS

FIELD

This disclosure relates generally to Information Handling Systems (IHSs), and more specifically, to systems and methods for using contextual center-of-gravity for outputting audio in collaborative environments.

BACKGROUND

As the value and use of information continues to increase, individuals and businesses seek additional ways to process and store information. One option available to users is Information Handling Systems (IHSs). An IHS generally processes, compiles, stores, and/or communicates information or data for business, personal, or other purposes thereby allowing users to take advantage of the value of the information. Because technology and information handling needs and requirements vary between different users or applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Electronic collaboration is a manner of human interaction carried out via technology-mediated communication. In many implementations, IHSs may be deployed to facilitate the establishment of "collaboration sessions" or "virtual meetings." Examples of IHS-based applications that may be invoked during such a collaboration session include video conferencing and whiteboarding. These, and other IHS-based collaboration tools, allow people to work on the same materials remotely.

The inventors hereof have recognized a need for new tools that enable better team interactions and improve effectiveness in the workplace, particularly as the workforce becomes more geographically-distributed and as the volume of business information created and exchanged increases to unprecedented levels. Unfortunately, conventional tools are fragmented, do not adequately address problems specific to real-time interactions, and do not effectively employ contextual information for gains in productivity and ease of use.

SUMMARY

Embodiments of systems and methods for using contextual Center-of-Gravity (CoG) for outputting audio in collaborative environments are described. In an illustrative, non-limiting embodiment, an Information Handling System (IHS) may include: a processor; and a memory coupled to the processor, the memory having program instructions stored thereon that, upon execution by the processor, cause the IHS to: identify a first position of a first participant and a second position of a second participant during a collaboration session; calculate a CoG based, at least in part, upon the first and second positions; and output audio during the collaboration session with a level determined based upon the CoG.

To identify the position, the program instructions, upon execution by the processor, may cause the IHS to use at least one of: a proximity sensor, an RGB camera, or an IR/NIR camera. The program instructions, upon execution by the processor, may cause the IHS to classify the first and second participants as at least one of: near-field, mid-field, or far-field.

In some cases, to calculate the CoG, the program instructions, upon execution by the processor, may cause the IHS to calculate an average distance from each participant's current position to a reference location. The average distance may be calculated in three-dimensions using a first height of the first participant and a second height of the second participant.

To output the audio, the program instructions, upon execution by the processor, may cause the IHS to increase the level during at least a portion of the collaboration session in response to movement of the CoG away from the reference location. Additionally, or alternatively, to output the audio, the program instructions, upon execution by the processor, further cause the IHS to decrease the level during at least a portion of the collaboration session in response to movement of the CoG toward the reference location. Additionally, or alternatively, to output the audio, the program instructions, upon execution by the processor, further cause the IHS to look-up a loudness value corresponding to the level.

The IHS may be coupled to an electronic display where a remote video feed is rendered during at least a portion of the collaboration session, and the reference location may include the electronic display. Additionally, or alternatively, the program instructions, upon execution by the processor, may cause the IHS to identify a first context of the first participant and a second context of the second participant, and to calculate the average distance using weights associated with the first and second contexts, respectively. Additionally, or alternatively, the program instructions, upon execution by the processor, may cause the IHS to classify each of the first and second context as at least one of: speaking, gesturing, or whiteboarding.

The program instructions, upon execution by the processor, may cause the IHS to: receive a plurality of audio streams from a remote location; determine that an audio stream contains speech by a third participant; and in response to a position of the third participant in the remote location, adjust the level. Additionally, or alternatively, the program instructions, upon execution by the processor, further cause the IHS to: receive a plurality of audio streams from a remote location; determine that an audio stream contains speech by a third participant; and in response to a context of the third participant in the remote location, adjust the level.

In another illustrative, non-limiting embodiment, a method may include identifying a first position of a first participant and a second position of a second participant during a collaboration session; calculating a CoG based, at least in part, as an average between a first distance between the first position and a reference location and a second distance between the second position and the reference location; and outputting audio during the collaboration session with a sound volume determined based upon the CoG.

The method may include calculating an increase or decrease in the sound volume during at least a portion of the collaboration session in response to movement of the CoG.

To output the audio, the method may include using a loudness table with acoustic calibration data. The method may also include identifying a first context of the first participant and a second context of the second participant, and calculating the average distance using weights associated with the first and second contexts, respectively.

In yet another illustrative, non-limiting embodiment, a hardware memory device may have program instructions stored thereon that, upon execution by a processor of an Information Handling System (IHS), cause the IHS to: identify a first position of a first participant and a second position of a second participant during a collaboration session; calculate a first CoG based, at least in part, upon the first and second positions; output audio during the collaboration session with a first level determined based upon the first CoG; update at least one of the first or second positions; calculate a second CoG based, at least in part, upon the updated position; and output audio during the collaboration session with a second level determined based upon the second CoG.

The program instructions, upon execution by the processor, may further cause the IHS to: receive a plurality of audio streams from a remote location; determine that an audio stream contains speech by a third participant; and in response to a position of the third participant, adjust a level of the audio stream relative to other audio streams. Additionally, or alternatively, the program instructions, upon execution by the processor, may further cause the IHS to: receive a plurality of audio streams from a remote location; determine that an audio stream contains speech by a third participant; and in response to a context of the third participant, adjust a level of the audio stream relative to other audio streams.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Figure 1A:
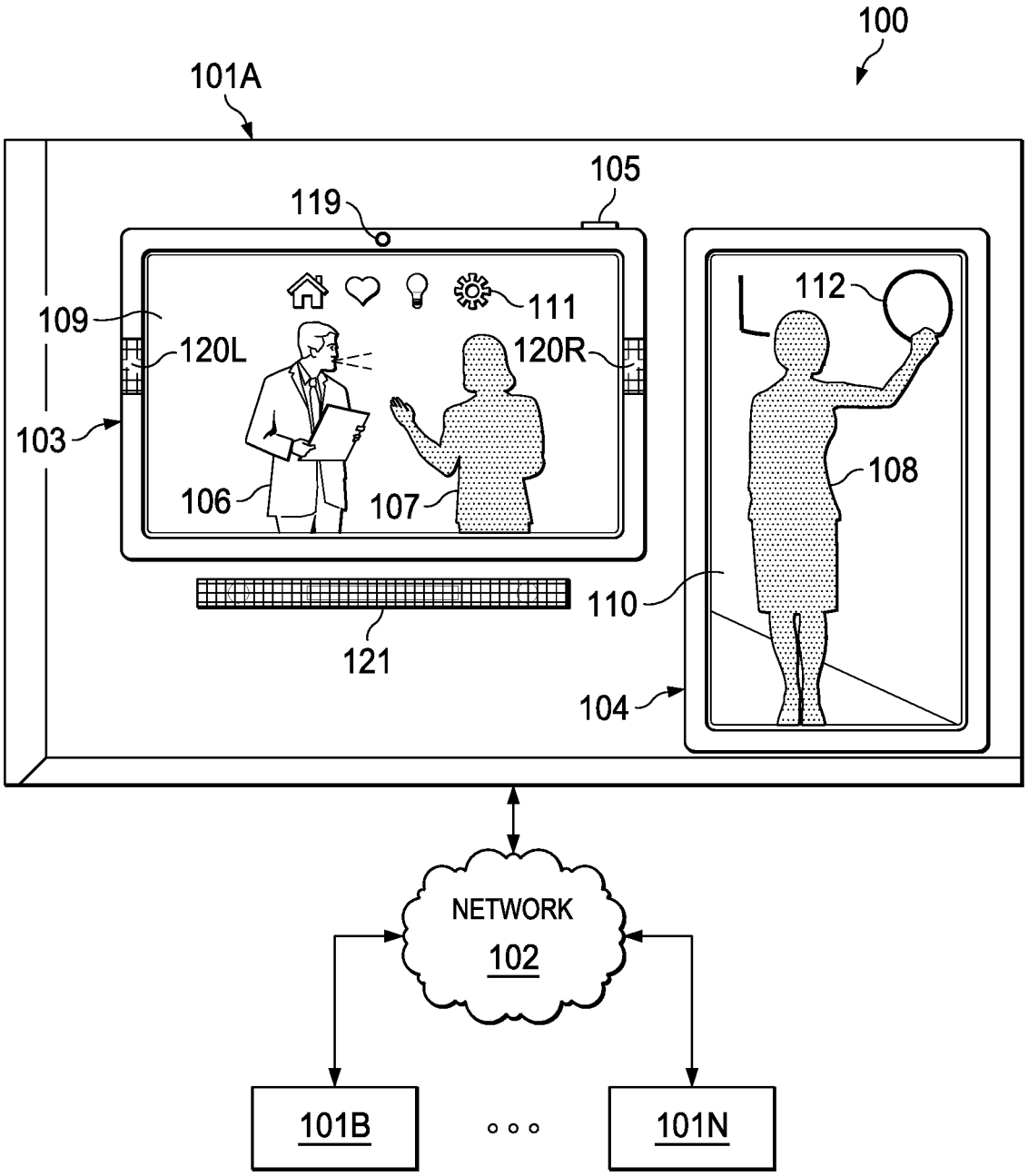
FIGS. 1A and 1B illustrate examples of collaboration environments where systems and methods for using contextual center-of-gravity for outputting audio may be deployed, according to some embodiments.

FIG. 1A illustrates an example of collaboration environment 100 where systems and methods for using contextual center-of-gravity for outputting audio may be deployed. As shown, displays 103 and 104 operate as meeting point and/or shared digital whiteboard for conference room or location 101A, that enable electronic collaboration sessions among distributed participants operating like systems in other locations 101B-N over network 102.

Figure 2:
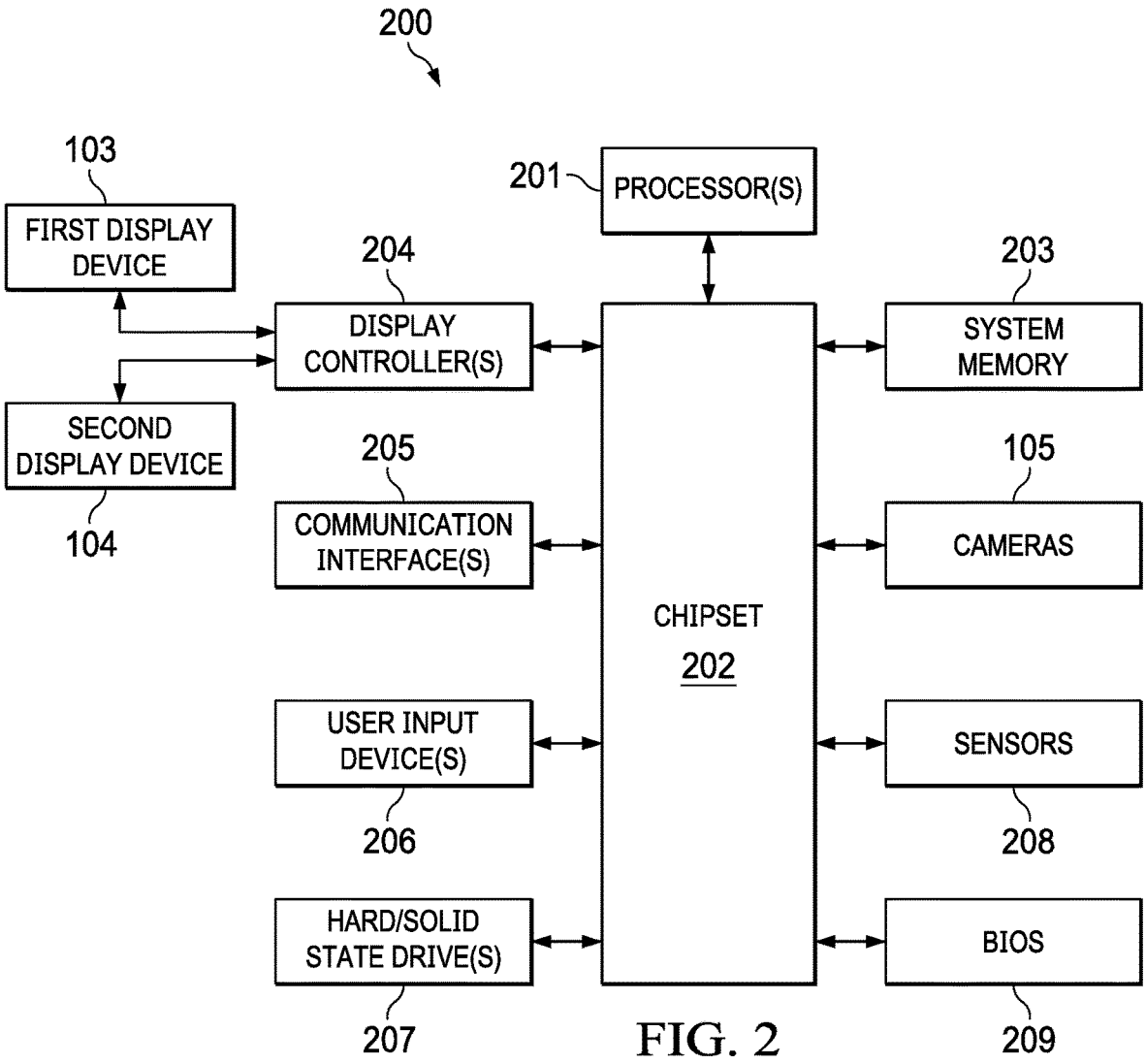
FIG. 2 illustrates an example of hardware components of an Information Handling System (IHS), according to some embodiments.

Displays 103 and 104 are operated in location 101A by IHS 200 (depicted in FIG. 2). IHS 200 is also coupled to camera(s) 105 and to a plurality of other sensors. These sensors may include but are not limited to: electric, magnetic, radio, optical, infrared, thermal, force, pressure, acoustic, ultrasonic, proximity, position, direction, movement, velocity, rotation, and/or acceleration sensor(s). Based upon data obtained from camera(s) 105 and from these various sensors, IHS 200 may manage the telepresence of one or more participants during the collaboration session.

In this example, in response to receiving prioritized content from a remote location, display 103 renders a close-up video image of speaking participant 106, a silhouette of gesturing participant 107, and augmented content 111, overlaid upon far-field video stream 109. Display 104 renders a silhouette of whiteboarding participant 108 as she produces whiteboarding content 112 over far-field video stream 110. For example, participants 106 and 107 shown in display 103 at location 101A may actually be present at location 101B, and participant 108 may be present at location 101N.

With respect to audio, microphone(s) 119 may be integrated into display(s) 103/104, on a conference table, or distributed across the room. In other cases, two microphones may be used. In yet other cases, three or more microphones may be used (e.g., to help triangulate a given participant as the source of an utterance, for example). Displays 103 and/or 104 may have a set of loudspeakers built in, here shown as speakers 120L and 120R. Additionally, or alternatively, soundbar 121 may be mounted on the wall under or above displays 103/104. Additionally, or alternatively, location 110A may be equipped with a speaker array, surround speaker system, or the like, distributed across various spots in the room.

Figure 1B:
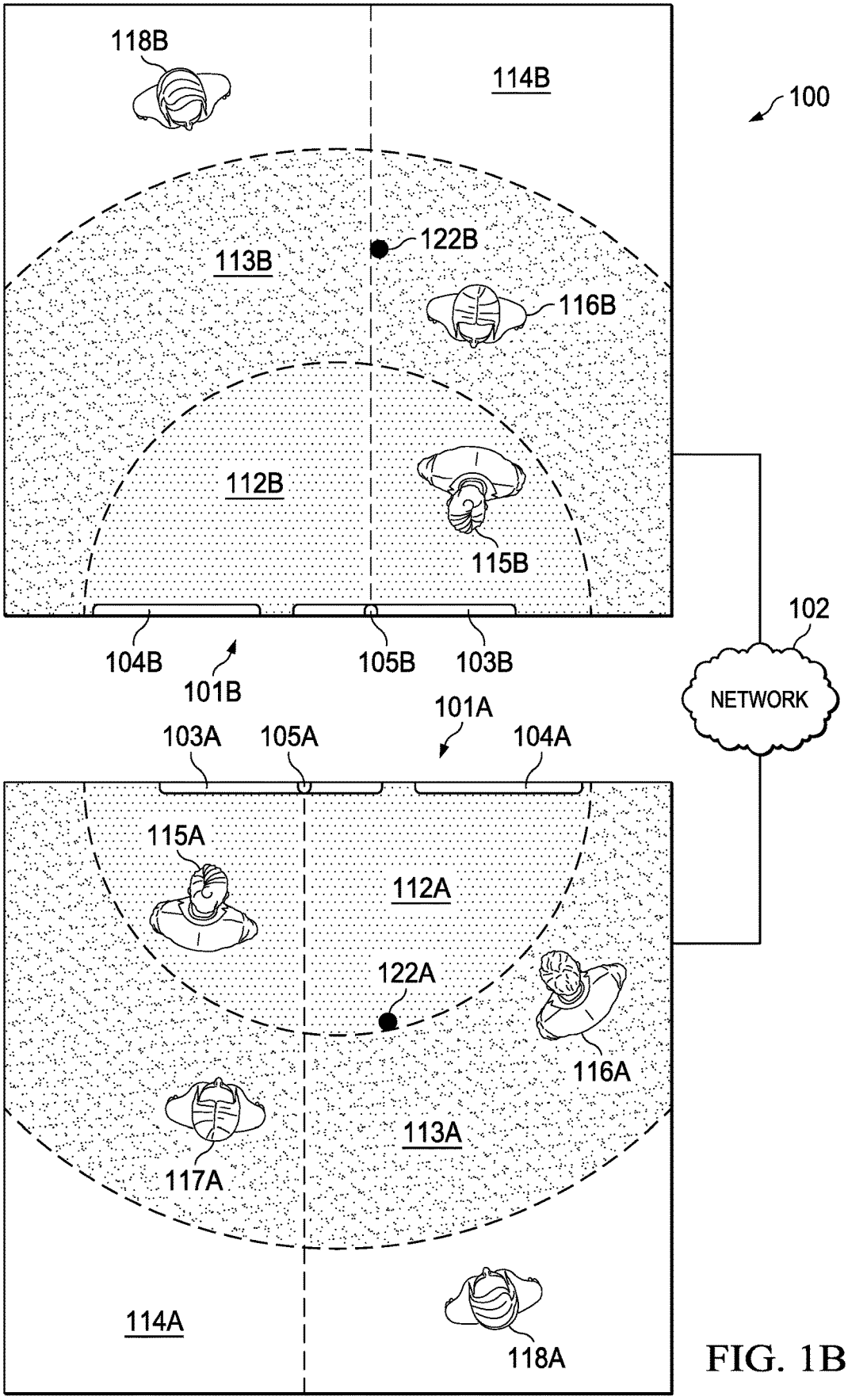

FIG. 1B shows an example of a scenario taking place in locations 101A and 101B during a collaboration session, such that location 101A is divided into three proximity zones: near-field 112A, mid-field 113A, and far-field 114A. Similarly, location 101B is divided into near-field 112B, mid-field 113B, and far-field 114B. In this case, participants 115A-118A are physically present in location 101A: participant 115A is in near-field 112A, participants 116A and 117A are in mid-field 113A, and participant 118A is in far-field 114A. Moreover, participants 115B, 116B, and 118B are physically present in location 101B, such that participant 115B is in near-field 112B, participant 116B is in mid-field 113B, and participant 118B is in far-field 114B.

When a remote participant (e.g., participant 115B) is whiteboarding (or "inking") with a local participant (e.g., participant 115A), it might become important to have displays 103/104 focus on whiteboard contents rather than the overlaid video on glass, in order for other participants that are co-located with the local participant (e.g., participants 116A-118A) to see the annotated content. But, when someone far-field on a conference table (e.g., participant 118A) is speaking, for example, it might be more important to switch the outgoing data feed to the 2D camera far field view (or to indicate the event in outgoing metadata).

In various implementations, upon receiving of audio layers from multiple remote sources (e.g., location 101B) it may be desirable, when multiple local participants are present in location 101A, that IHS 200 not turn up the audio volume (multiplexed from layers from one of more remote sources) to cater to the far-field local participants only (e.g., participant 118A), which would make the audio volume too high for near-field participants (e.g. participant 115A). Conversely, it may be desirable that IHS 200 not turn down the audio volume to cater to the near-field local participants only (e.g., participant 115A), which would make the audio volume too low for far-field participants (e.g. participant 118A).

To address these, and other issues, IHS 200 at location 101A may be configured to use a contextual Center-of-Gravity for outputting audio received from remote locations 101B-N during a collaboration session. As used herein, the term "Center-of-Gravity" of "CoG" is defined as the centroid of location of in-room participants with respect to a reference or origin point. For sake of illustration, room 101A shows CoG 122A in near-field area 112A, and room 1018 shows a different CoG 122B in mid-field area 113B, depending upon the distribution and context of each participant in that room. In response to the present location of the CoG, which can change dynamically throughout a collaboration session, IHS 200 (managing the session in room 101A) may output received audio from other locations 101B-N at different levels. These, and other techniques, are described in more detail below with respect to FIGS. 3 and 5.

Network 102 may include one or more wireless networks, circuit-switched networks, packet-switched networks, or any combination thereof to enable communications between two or more of IHSs. For example, network 104 may include a Public Switched Telephone Network (PSTN), one or more cellular networks (e.g., third generation (3G), fourth generation (4G), or Long Term Evolution (LTE) wireless networks), satellite networks, computer or data networks (e.g., wireless networks, Wide Area Networks (WANs), Metropolitan Area Networks (MANs), Local Area Networks (LANs), Virtual Private Networks (VPN), the Internet, etc.), or the like.

For purposes of this disclosure, an IHS may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an IHS may be a personal computer (e.g., desktop or laptop), tablet computer, mobile device (e.g., Personal Digital Assistant (PDA) or smart phone), server (e.g., blade server or rack server), a network storage device, or any other suitable device and may vary in size, shape, performance, functionality, and price. An IHS may include Random Access Memory (RAM), one or more processing resources such as a Central Processing Unit (CPU) or hardware or software control logic, Read-Only Memory (ROM), and/or other types of nonvolatile memory. Additional components of an IHS may include one or more disk drives, one or more network ports for communicating with external devices as well as various I/O devices, such as a keyboard, a mouse, touchscreen, and/or a video display. An IHS may also include one or more buses operable to transmit communications between the various hardware components.

FIG. 2 is a block diagram of examples of hardware components of IHS 200. As depicted, IHS 200 includes processor 201. In various embodiments, IHS 200 may be a single-processor system, or a multi-processor system including two or more processors. Processor 201 may include any processor capable of executing program instructions, such as a PENTIUM series processor, or any general-purpose or embedded processor implementing any suitable Instruction Set Architectures (ISA), such as an x86 ISA or a Reduced Instruction Set Computer (RISC) ISA (e.g., POWERPC, ARM, SPARC, MIPS, etc.).

IHS 200 includes chipset 202 coupled to processor 201. In certain embodiments, chipset 202 may utilize a QuickPath Interconnect (QPI) bus to communicate with processor 201. Chipset 202 may provide processor 201 with access to a number of resources. Moreover, chipset 202 may be coupled to communication interface(s) 205 to enable communications via various wired and/or wireless networks, such as Ethernet, WiFi, BLUETOOTH, cellular or mobile networks (e.g., CDMA, TDMA, LTE, etc.), satellite networks, or the like. For example, communication interface(s) 205 may be coupled to chipset 202 via a PCIe bus.

Chipset 202 may be coupled to display controller(s) 204, which may include one or more or graphics processor(s) (GPUs) on a graphics bus, such as an Accelerated Graphics Port (AGP) or Peripheral Component Interconnect Express (PCIe) bus. As shown, display controller(s) 204 provide video or display signals to first display device 103 and second display device 202. In other implementations, any number of display controller(s) 204 and/or display devices 103/104 may be used.

Each of display devices 103 and 104 may include a flexible display that is deformable (e.g., bent, folded, rolled, or stretched) by an external force applied thereto. For example, display devices 103 and 104 may include LCD, OLED, or AMOLED, plasma, electrophoretic, or electrowetting panel(s) or film(s). Each display device 103 and 104 may include a plurality of pixels arranged in a matrix, configured to display visual information, such as text, two-dimensional images, video, three-dimensional images, etc.

Display device(s) 103/104 may be configured to sense haptic and/or physical touch events, and to generate touch information. To this end, display device(s) 103/104 may include a touchscreen matrix (e.g., a layered capacitive panel or the like) and/or touch controller configured to receive and interpret multi-touch gestures from a user touching the screen with a stylus or one or more fingers. In some cases, display and touch control aspects of display device(s) 103/104 may be collectively operated and controlled by display controller(s) 204.

Chipset 202 may also provide processor 201 and/or display controller(s) 204 with access to system memory 203. In various embodiments, system memory 203 may be implemented using any suitable memory technology, such as static RAM (SRAM), dynamic RAM (DRAM) or magnetic disks, or any nonvolatile/Flash-type memory, such as a solid-state drive (SSD) or the like. System memory 203 may store program instructions that, upon execution by processor 201 and/or controller(s) 204, present a UI interface to a user of IHS 200.

Upon booting of IHS 200, processor(s) 201 may utilize Basic Input/Output System (BIOS) 209 instructions to initialize and test hardware components coupled to IHS 200 and to load an Operating System (OS) for use by IHS 200. BIOS 209 provides an abstraction layer that allows the OS to interface with certain hardware components that are utilized by IHS 200. Via the hardware abstraction layer provided by BIOS 209, software stored in memory 203 and executed by the processor(s) 201 of IHS 200 is able to interface with certain I/O devices that are coupled to the IHS 200. As used herein, the term BIOS is also intended to encompass the Unified Extensible Firmware Interface (UEFI).

Chipset 202 may also provide access to one or more user input devices 206, for example, using a super I/O controller or the like. For instance, chipset 202 may provide access to a keyboard, mouse, trackpad, stylus, totem, or any other peripheral input device, including touchscreen displays 103 and 104. These input devices may interface with chipset 202 through wired connections (e.g., in the case of touch inputs received via display controller(s) 204) or wireless connections (e.g., via communication interfaces(s) 205).

Chipset 202 may further provide access to one or more hard disk and/or solid-state drives 207. In certain embodiments, chipset 202 may also provide an interface for communications with one or more sensors 208 and camera(s) 105.

Figure 3:
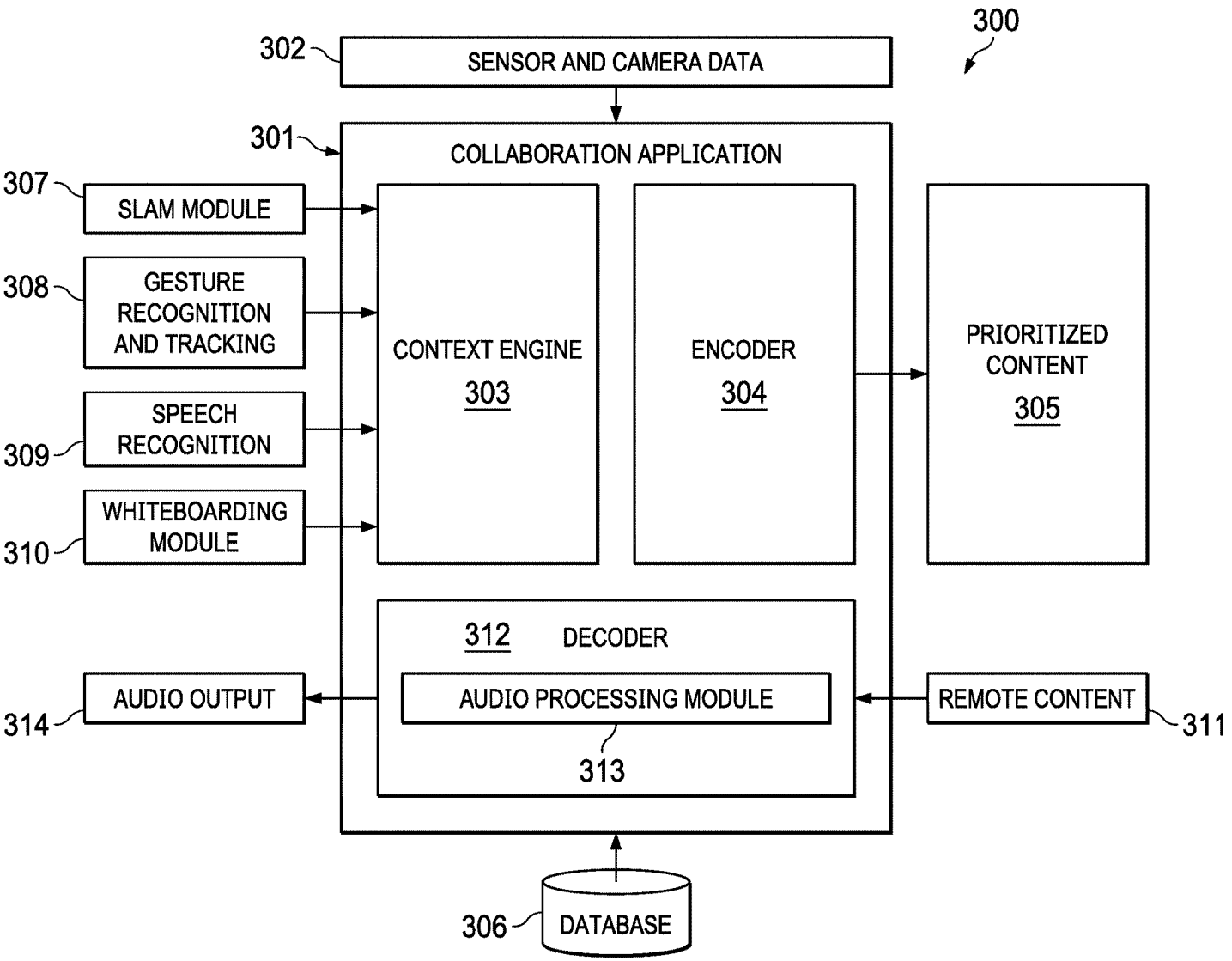
FIG. 3 illustrates an example of logic components of an IHS, according to some embodiments.

FIG. 3 illustrates examples of logic components 300 of IHS 200. In some embodiments, program instructions may be stored in system memory 203, for example, that upon execution by processor 201 of IHS 200, produces collaboration application 301. As such, IHS 200 may be configured to execute collaboration application 301 in the form of a web browser or native application.

In some embodiments, logic components 300 may manage information and content sharing in a collaboration session (e.g., video conferencing, augmented reality or design, whiteboarding, file sharing, etc.) using one or more of logic components 300. Collaboration application 301 may communicate data with another collaboration application (e.g., in location 101B), an application server, or other web services, using any suitable protocol such as, for example, Hypertext Transfer Protocol (HTTP) Secure (HTTPS).

Broadly speaking, collaboration application 301 may be configured to support a collaboration session and associated management. For example, collaboration application 301 may be configured to perform participant authentication and authorization, to detect and connect with other IHSs (e.g., peer-to-peer) or servers, to provide an Application Programming Interface (API) that enables various collaboration actions, and to broker audio and video communications, whiteboarding, and file transfers, etc. Collaboration application 301 may also handle operations such as: creating and managing meetings, linking virtual workspaces, notifying participants of invitations, providing configuration for auto calling (push/pull) participants, etc.

In various embodiments, collaboration application 301 may receive locally produced collaboration session content, such as sensor and camera data 302, and it may determine how to send that content—or what content to send—to a remote IHS. To this end, collaboration application 301 executes context engine 303, ascertains the proximity and/or context of one or more participants (based on database 306), and outputs prioritized collaboration session content 305 via encoder 304.

Simultaneous Localization and Mapping (SLAM) module 307 may operate based upon landmarks found in the video frames received from camera(s) 105. Particularly, SLAM module 307 may be configured to implement tracking techniques that use distinctive visual characteristics of the physical environment to identify specific images or shapes which are then usable to calculate a participant's position and pose. To this end, SLAM module 307 uses positional tracking devices among camera(s) 105 and sensor(s) 208 (e.g., in the IR spectrum).

In some cases, SLAM module 307 may include a propagation component, a feature extraction component, a mapping component, and an update component. The propagation component may receive angular velocity and/or accelerometer data, and it may use that data to produce a new position and/or pose estimation. At least one of camera(s) 105 (e.g., a depth-sensing camera) may provide video frames to the feature extraction component, which extracts useful image features (e.g., using thresholding, blob extraction, template matching, etc.), and generates a descriptor for each feature.

These features, also referred to as "landmarks," are then fed to the mapping component. The mapping component may be configured to create and extend a map, as participants move in space. Landmarks may also be sent to the update component, which updates the map with the newly detected feature points and corrects errors introduced by the propagation component.

To enable positional tracking for SLAM purposes, different positional tracking sources or devices may be used. For example, wireless tracking may use a set of anchors or lighthouses that are placed around the perimeter of a room, and/or one or more electronic totems or smart tags that are tracked; such that SLAM module 307 triangulates its position and/or state using those elements. Inertial tracking may use data from an accelerometer and/or gyroscope within a Head-Mounted Device (HMD) worn by a user, for example, to find a velocity (e.g., m/s) and position of that participant relative to an initial point. Acoustic tracking may use ultrasonic sensors to determine the position of participants by measuring time-of-arrival and/or phase coherence of transmitted and receive sound waves.

Optical tracking may include any suitable computer vision algorithm and tracking device, such as a camera of visible (RGB), IR, or NIR range, a stereo camera, and/or a depth camera. In some cases, cases, marker-less tracking may use continuous searches and feature extraction techniques from video frames obtained by camera(s) 105 (e.g., using visual odometry) to find natural visual landmarks (e.g., a window) in the environment.

An estimator, such as an Extended Kalman filter (EKF) or the like, may be used for handling the propagation component. A map may be generated as a vector stacking sensors and landmarks states, modeled by a Gaussian variable. The map may be maintained using predictions (e.g., when participants move) and/or corrections (e.g., camera 105 observes landmarks in the environment that have been previously mapped).

Gesture Recognition and Tracking (GRT) module 308 may also use one or more camera(s) 105 or optical sensors 208 that enable participants to use their actual hands for interaction with virtual objects (VOs) rendered by displays 103/104. For example, GRT module 308 may be configured to implement hand tracking and gesture recognition in a 3-D space via a user-facing 2-D camera. In some cases, GRT module 308 may track a selectable number of degrees-of-freedom (DOF) of motion, with depth information, to recognize dynamic hand gestures (e.g., swipes, clicking, tapping, grab and release, etc.) usable to control or otherwise interact with collaboration application 301.

Gesture detection begins when video frame data (e.g., a video or depth-video stream) is received from gesture or RGB camera(s) 105, and processed to identify various gestures and sequences that constitute user input. At least a portion of the user's body may be identified in the video frame data. For example, through image processing, a given locus of a video frame or depth map may be recognized as belonging to a participant. Pixels that belong to the participant (e.g., arms, hands, fingers, etc.) may be identified, for example, by sectioning off a portion of the video frame or depth map that exhibits above-threshold motion over a suitable time scale, and attempting to fit that section to a geometric model of the participant. If a suitable fit is achieved, then pixels in that section may be recognized as those of the participant.

GRT module 308 may be configured to analyze pixels of a video frame or depth map that correspond to a participant, in order to determine what part of the user's body each pixel represents. A number of different body-part assignment techniques may be used. In an example, each pixel of the video frame or depth map may be assigned a body-part index. The body-part index may include a discrete identifier, confidence value, and/or body-part probability distribution indicating the body part or parts to which that pixel is likely to correspond.

For example, machine-learning may be used to assign each pixel a body-part index and/or body-part probability distribution. Such a machine-learning method may analyze a user with reference to information learned from a previously trained collection of known gestures and/or poses stored in a calibration database. During a supervised training phase, for example, a variety of gesture sequences may be observed, and trainers may provide label various classifiers in the observed data. The observed data and annotations may then be used to generate one or more machine-learned algorithms that map inputs (e.g., observation data from a depth camera) to desired outputs (e.g., body-part indices for relevant pixels).

Thereafter, a partial virtual skeleton may be fit to at least one body part identified. In some embodiments, a partial virtual skeleton may be fit to the pixels of video frame or depth data that correspond to a human arm, hand, and/or finger(s). A body-part designation may be assigned to each skeletal segment and/or each joint. Such virtual skeleton may include any type and number of skeletal segments and joints, including each individual finger.

In other embodiments, however, the use of a virtual skeleton may not be necessary. For example, in other implementations, raw point-cloud data may be sent directly to a feature extraction routine within a gesture recognition module.

Examples of one and two-handed gestures that may be recognized or tracked by GRT module 308 include, but are not limited to: gestures for selecting and deselecting VOs, gestures for manipulating selected VOs (e.g., rotation and/or translation following the user's hand direction, position, and/or location), gestures for performing menu operations such as opening, closing, and/or repositioning (again, with menu rotation and/or translation following the user's hand), and gestures for manipulating applications, windows, or workspaces (e.g., using downward or upward swiping hand motion), among many others.

Speech recognition module 309 operates with one or more microphones (sensors 208) and it may be configured to receive, process, and recognize speech from near- and far-field sources. In many cases, speech recognition module 309 may include circuitry and/or program instructions configured to perform beamforming, echo cancellation, noise suppression, integrated audio decoding and post-processing, and/or multi-room networking and audio output. In general, speech recognition may be accomplished using: (a) a recurrent neural network (RNN), which handles audio-to-character or phoneme conversion, and (b) a language model, which converts raw character/phoneme input into grammatically correct sentences and thoughts using n-gram beam search methods.

Whiteboarding module 310 operates with one or more touchscreen or digitizers (sensors 208) built into displays 103/104. Generally, whiteboarding module 310 enables the placement of shared images, documents, or other files on shared displays 103/104. Whiteboarding module 310 also lets participants perform hand annotations, as if on a physical whiteboard. In some implementations, one or more of displays 103/104 may be frosted by manipulating its alpha channel settings, referend to as "frost" or "whiteboarding" mode, or it may be left in "glass" mode (e.g., a normal LCD display).

Context engine 303 prioritizes outgoing data stream (and incoming data stream) based upon context and proximity. As described in more detail in FIGS. 4A and 4B below, context engine 303 may be configured to: receive a set of audio and video inputs to IHS 200 as sensor and camera data 302, along with the outputs from SLAM module 307, GRT module 308, speech recognition module 309, and whiteboarding module 310; and it may provide information to encoder 304, based upon database 306, to produce prioritized content 305. As part of this process, context engine 303 and/or encoder 304 may be configured to leverage post-processing alpha channel to frost displays 103/104, to render a whiteboard with/without near-field participant silhouette/video feed, to produce a 3D virtual camera view (e.g., using switching methods), and/or to perform depth calculations for participants using camera(s) 105.

In some cases, context engine 303 may include a calibration routine to configure near, mid, and far-field distance "zones" within a room, for example, with respect to display 103 and/or camera 105. Database 306 may include rules, settings, parameters, and preferences for auto-switching and/or prioritization of content based on proximity and/or context. For example, auto-switching may be enabled with a hierarchical set of rules, stored in database 306, for prioritizing ink content versus any of the various video feeds, whiteboarding content, VOs or augmented content, etc.

Once outgoing collaboration session content is prioritized by content engine 303, encoder 304 may generate metadata that indicates the prioritization to a remote IHS's decoding that content. For example, each different type of content (e.g., video feed content, whiteboarding content, and overlay or augmented content) may be attributed a score (e.g., 1 to 5, high or low, etc.) that indicates the priority of that content relative to other content, and the scores may be provided to the remote IHS in real-time during the communication session. Additionally, or alternatively, encoder 304 may selective encode and transmit higher priority content while withholding lower priority content. In some cases, outgoing data feeds may be switched on or off based on proximity/context to conserve or control uplink bandwidth.

In some cases, collaboration session content that may be individually prioritized, for transmission and/or remote display, may include, but is not limited to: a near-field video feed, a far-field video feed, an IR/NIR video feed, a depth camera video feed, shared workspace or application content, whiteboarding/inking/annotation content, and augmented content (e.g., VOs subject to gesturing commands).

On the reverse direction, collaboration application 301 may receive remote content 311 from other locations (e.g., location 101B), including audio and/or video and/or contents that have been prioritized by a remote IHS, and it may decode that content with decoder 312. As part of the decoding process, audio processing module 313 may be configured to execute method 500 of FIG. 5, as described in more detail below, in order to implement techniques for outputting audio based on contextual center-of-gravity calculations. Audio output stage 314 may provide a decoded and CoG-processed audio signal to a sound card, or the like, for reproduction via speakers 120L-R and/or 121 in room 101A.

Figure 4A:
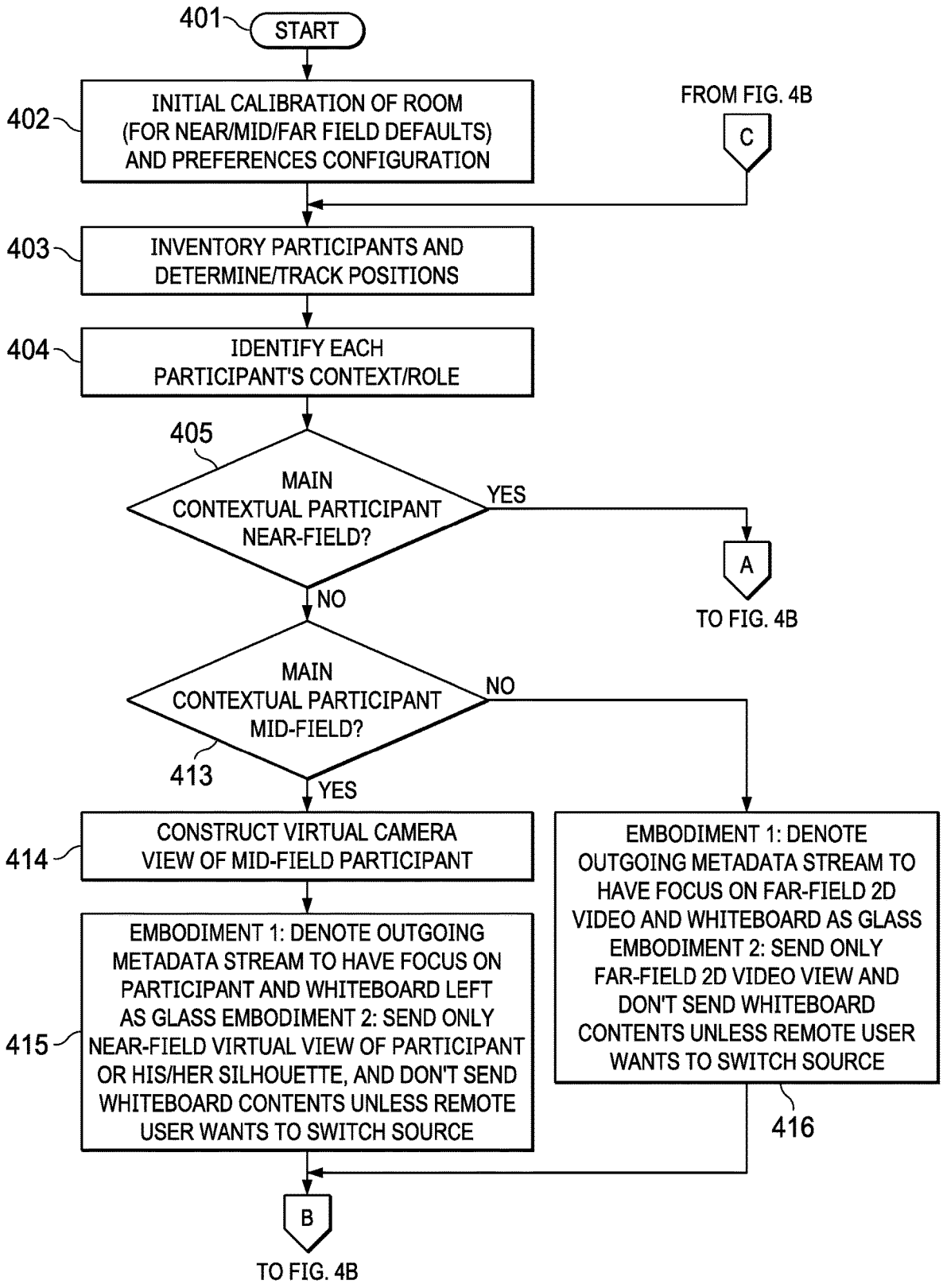
FIGS. 4A and 4B illustrate an example of a method for providing proximity and context-based telepresence during a collaboration session, according to some embodiments.
Figure 4B:
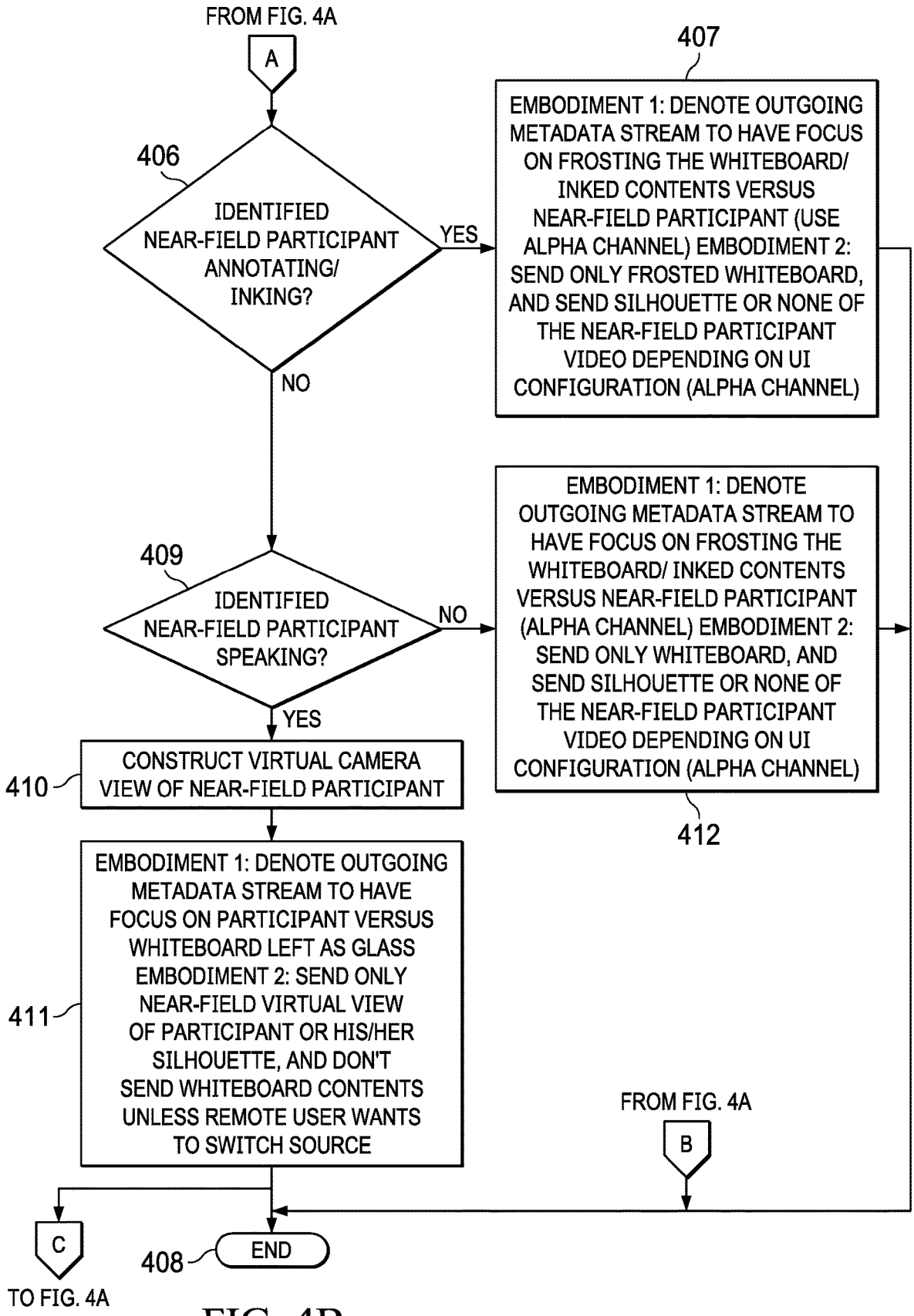

FIGS. 4A and 4B are a flowchart of method 400 for providing proximity and context-based telepresence during a collaboration session. In various embodiments, method 400 may be performed, at least in part, by operation of context engine 303 within application 301 during a collaboration session. Particularly, method 400 begins at block 401.

At block 402, method 400 performs a calibration operation for a physical room where an electronic collaboration session is to take place (e.g., a conference room or an office with displays 103/104, etc.). Block 402 also configures, in database 306, various settings, parameters, rules, and preferences discussed herein. For example, block 402 may store "proximity zones" that include a "near-field" parameter (e.g., participant<3 feet from display 103 or camera 105), a "mid-field" parameter (e.g., participant between 3 feet and 10 feet), and a "far-field" parameter (e.g., participant>10 feet).

At block 403, method 400 inventories all the participants in a room, for example, using SLAM module 307, proximity sensors, and/or by employing image processing techniques upon image frames obtained with camera(s) 105. Still as part of block 403, method 400 may determine and track the position and/or distance of each participant with respect to display 103 or camera 105, for example. In some cases, method 400 may use proximity alone to prioritize content, such that when an engaged participant is in the near field, whiteboard content is prioritized; but when the engaged participant is in the mid or far fields, video content from that location is prioritized. In those cases, block 404 may be skipped.

Otherwise, block 404 identifies each participant's role or context during the collaboration session. For example, with respect to roles, a participant may be an ordinary member of the session. A moderator may be an owner of the meeting workspace and leader that moderates the participants of the meeting. Often the moderator has full control of the session, including material content, what is displayed on the master workspace, and the invited list of participants. An editor may include a meeting participant or the moderator who has write privileges to update content in the meeting workspace. As to context, a participant may be speaking (e.g., engaging speech recognition module 309), inking (e.g., engaging whiteboarding module 310), or gesturing (e.g., engaging GRT module 308) from one or more of the proximity zones.

From block 405 on, rules from database 306 may be invoked in response to the determined position and/or context of one or more participants. Specifically, block 405 determines whether a main contextual participant is in the near-field. If so, block 406 determines whether the identified near-filed participant is also inking or annotating (e.g., engaging whiteboarding module 310). If so, in a first embodiment of block 407, encoder 304 denotes an outgoing metadata stream to prioritize the frosting of a receiving display (for a whiteboard effect using alpha channel techniques) and the transmission of whiteboarding content, over video content of the near-field participant. In a second embodiment, encoder 304 sends only the whiteboarding content and not the video feed of the participant. Additionally, or alternatively, the video of the participant may be replaced with a silhouette prior transmission of prioritized content 305.

Back at block 406, if the identified near-field participant is not inking or annotating, control passes to block 409. At block 409, method 400 determines whether the identified near-field participant is speaking. If so, at block 410 encoder 304 constructs a virtual camera view of the participant, for example, using 3D stitching techniques. At block 411, in a first embodiment, encoder 304 denotes an outgoing metadata stream to prioritize the video content of the participant, and the receiving display is instructed to stay in shared workspace or "glass" mode. In a second embodiment, encoder 304 sends only the near-field virtual view of the participant or silhouette, and withholds whiteboarding content unless otherwise instructed by the remote IHS.

Still at block 409, if the identified near-field participant is not speaking, control passes to block 412. At block 412, in a first embodiment, encoder 304 denotes an outgoing metadata stream to prioritize the frosting of a receiving display (for a whiteboard effect using alpha channel techniques) and the transmission of whiteboarding content, over video content of the near-field participant. Additionally, or alternatively, encoder 304 may prioritize the transmission and/or rendering of overlay or augmented content subject to GRT interactions (via GRT module 308). In a second embodiment, encoder 304 sends only the whiteboarding and/or overlay content, unless otherwise instructed by the remote IHS. a proximity sensor, an RGB camera, or an IR/NIR camera Additionally, or alternatively, overlay content is always transmitted and/or displayed, but it may fade when it is not referenced (pointed at or interacted with by any local and/or remote participant).

Back to block 405, if the main contextual participant is not in the near-field, block 413 determines whether that participant is in the mid-field. If not, control passes to block 416. At block 416, in a first embodiment, encoder 304 denotes an outgoing metadata stream to prioritize a far-field 2D video content (e.g., from one of camera(s) 105)) and instructs the receiving display to stay in glass mode. In a second embodiment, only far-field 2D video content is transmitted, and whiteboarding content is withheld unless otherwise instructed by the remote IHS.

If block 413 determines that the main contextual is in the mid-field, block 414 constructs a virtual camera view of the participant, for example, using 3D stitching techniques. In a first embodiment of block 415, encoder 304 denotes an outgoing metadata stream to prioritize the video content of the participant, and the receiving display is instructed to stay in shared workspace or "glass" mode. In a second embodiment, encoder 304 sends only the near-field virtual view of the participant or silhouette, and withholds whiteboarding content unless otherwise instructed by the remote IHS. In some cases, blocks 403-416 may be repeated periodically (e.g., every N milliseconds), for the duration of the collaboration session.

Examples of other content prioritization actions include, but are not limited to: frosting of an entire or a portion of a receiving display (e.g., to emphasize ongoing whiteboarding operations), fading of overlaid VOs (e.g., when not referenced by gesturing for a threshold duration), fading of far-field video around a participant's displayed image (e.g., when a near-field participant is active), fading of near-field video of a participant's image (e.g., when a far-field participant is active), replacing a participant's body image with a silhouette or contour of that participant (e.g., to provide a replacement image for the participant), etc. Any of these actions may be performed in response to a participant entering or leaving a selected proximity region (e.g., near, mid, or far-field) and/or engaging in any selected contextual activity (e.g., inking, speaking, gesturing, etc.). Moreover, in some cases, content prioritization may follow different rules depending upon whether the content is to be displayed in display 103 or 104. For example, display 103 may provide an interactive screen with whiteboarding capabilities, and display 104 may provide a non-interactive video feed.

Figure 5:
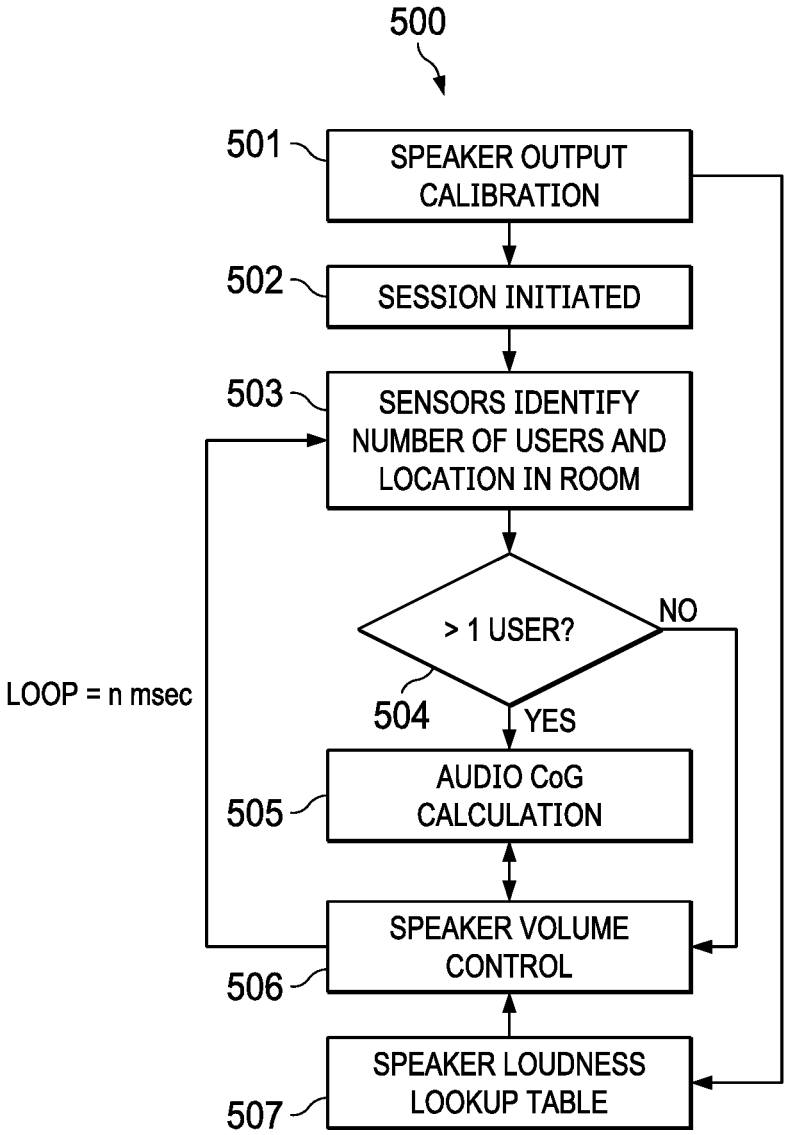
FIG. 5 illustrates an example of a method for using contextual center-of-gravity for outputting audio in collaborative environments, according to some embodiments.

FIG. 5 illustrates an example of method 500 for using contextual center-of-gravity for outputting audio in room 101A part of collaborative environment 100. In various embodiments, method 500 may be implemented as a software service on IHS 200, with an acoustic calibration and/or characterization of room 101A, to determine location of in-room participants, leverage metadata information from incoming audio layers for their relative loudness/location, calculate a contextual CoG, and then set the audio output volume based on the CoG. The output volume may be updated throughout the collaboration session as local and/or remote participants move in their respective rooms or change context/activity during the session (e.g., the same person switches from whiteboarding to gesturing to speaking-only).

At block 501, method 500 may initiate a speaker output calibration procedure. For example, with display 103 mounted on the wall of room 101A, a microphone may be set in one or more positions in room 101A, one position at a time, to determine the sound intensity or loudness (Sound Pressure Level or "SPL") in those locations as a function of the audio output level or volume. Then, a loudness lookup table (LUT) 507 may be created in database 406 that associates an output level (e.g., a voltage level, a level between 1 and 10, etc.) with a resulting intensity or loudness (e.g., SPL in dB) at the desired location.

At block 502, method 500 detects initiation of a collaboration session, for example, between location 101A and 101B. At block 503, method 500 uses any available camera and/or sensor to identity a number of participants in room 101A, and their respective locations in that room ($d_1$, $d_2$, . . . $d_n$) in X, Y, and/or Z coordinates with respect to a reference or origin point.

In some cases, block 503 may receive landmark information from SLAM module 307 that indicates, throughout the duration of the session, the location of each participant in room 101A with respect to display 103, camera 105, microphone 119, and/or speakers 120L-R or 121. In other cases, a proximity sensor, an RGB camera image, or an IR/NIR camera frame may be used with otherwise conventional object detection techniques to find the number of participants and the location of each participant in room 101A.

At block 504, if there is only one participant in room 101A, control passes to block 507. Otherwise, if there are two or more participants in room 101A, block 505 may perform a CoG calculation using the number of participants and their positions, as determined by block 503. For example, to calculate a CoG, block 505 may employ the following equation:

$$CoG = \frac{d_1 + d_2 + d_3 + \ldots d_n}{n},$$

where $d_k=(X_k, Y_k, Z_k)$ for k in-room participants.

Accordingly, using this equation IHS 200 may calculate an average distance from each participant's current position to a reference location or origin in room 101A. The average distance may be calculated in three-dimensions using a first height of the first participant ($Z_1$) and a second height ($Z_2$) of the second participant. A height value may be estimated for each participant using a depth camera and/or image processing techniques. Additionally, or alternatively, at least one of the participants may wear an HMD configured to determine its pose and/or height.

In some cases, block 506 may receive the CoG value calculated by block 505 and it may determine an audio level corresponding to the CoG. For example, if the CoG in room 101A has moved closer to speakers 120L-R during the collaboration session, block 506 may reduce the audio level. Conversely, if the CoG has mover farther from speakers 120L-R, block 506 may increase the audio level. Block 506 may use speaker loudness LUT 507 to determine, for a desired SPL at the CoG, an amplitude of an audio signal to be output into speakers 120L-R. As the CoG moves around room 101A (e.g., new participants join, existing participants move, stand up, sit down, or leave the room), the level of the audio received from a remote location (e.g., 101B) and output by IHS 200 within room 101A may change to maintain a selected sound pressure level at that dynamically-changing location.

In other implementations, the CoG equation may be changed by adding contextual weights to each distance dk, depending upon the activities being performed by each respective participant in room 101A, and taking a weighted average. For example, if a participant is speaking, gesturing, or whiteboarding, its dk may be multiplied or divided by a corresponding contextual weight that causes the CoG to move toward to far-field 114A, mid-filed 114B, or near-field 114C, respectively—depending upon which activity is assigned a greater or lesser weight during the collaboration session.

In yet other implementations, remote content 311 may include a plurality of audio layers. For example, in room 101B, a first audio layer may include sound picked up from near-field 112B, a second audio layer may include sound picked up from mid-field 113B, and a third audio layer may include sound picked up from far-field 114B. In this case, the CoG of room 101A may be adjusted for each incoming layer, depending upon the remote participant's position in room 101B, to increase or reduce the audio level of that layer at the reference location in room 101A. Additionally, or alternatively, the CoG of room 101A may be adjusted for each incoming layer, depending upon the remote participant's context (e.g., speaking, gesturing, or whiteboarding).

As such, method 500 may configure IHS 200 to identify a first position of a first participant and a second position of a second participant during a collaboration session, calculate a CoG, and output audio during the collaboration session with a level determined based upon the CoG. Method 500 may the increase or decrease the level in response to movement of the CoG with respect to the reference location, for example, using calibrated loudness values.

It should be understood that various operations described herein may be implemented in software executed by logic or processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An Information Handling System (IHS), comprising:

a processor; and a memory coupled to the processor, the memory having program instructions stored thereon that, upon execution by the processor, cause the IHS to:

identify a first position of a first participant and a second position of a second participant during a collaboration session;

calculate an average distance from each participant's position to a reference location in three-dimensions using a first height of the first participant and a second height of the second participant;

calculate a Center-of-Gravity (CoG) based, at least in part, upon the average distance; and output audio during the collaboration session with a level determined based upon the CoG.

2. The IHS of claim 1, wherein to identify the position, the program instructions, upon execution by the processor, further cause the IHS to use at least one of: a proximity sensor, an RGB camera, or an IR/NIR camera.

3. The IHS of claim 1, wherein the program instructions, upon execution by the processor, further cause the IHS to classify the first and second participants as at least one of: near-field, mid-field, or far-field.

4. The IHS of claim 1, wherein to output the audio, the program instructions, upon execution by the processor, further cause the IHS to increase the level during at least a portion of the collaboration session in response to movement of the CoG away from the reference location.

5. The IHS of claim 4, wherein to output the audio, the program instructions, upon execution by the processor, further cause the IHS to decrease the level during at least a portion of the collaboration session in response to movement of the CoG toward the reference location.

6. The IHS of claim 4, wherein to output the audio, the program instructions, upon execution by the processor, further cause the IHS to look-up a loudness value corresponding to the level.

7. The IHS of claim 1, wherein the IHS is coupled to an electronic display where a remote video feed is rendered during at least a portion of the collaboration session, and wherein the reference location comprises the electronic display.

8. The IHS of claim 1, wherein the program instructions, upon execution by the processor, further cause the IHS to identify a first context of the first participant and a second context of the second participant, and to calculate the average distance using weights associated with the first and second contexts, respectively.

9. The IHS of claim 8, wherein the program instructions, upon execution by the processor, further cause the IHS to classify each of the first and second context as at least one of:

speaking, gesturing, or whiteboarding.

10. The IHS of claim 1, wherein the program instructions, upon execution by the processor, further cause the IHS to:

receive a plurality of audio streams from a remote location;

determine that an audio stream contains speech by a third participant; and in response to a position of the third participant in the remote location, adjust the level.

11. The IHS of claim 1, wherein the program instructions, upon execution by the processor, further cause the IHS to:

receive a plurality of audio streams from a remote location;

determine that an audio stream contains speech by a third participant; and in response to a context of the third participant in the remote location, adjust the level.

12. A method, comprising:

identifying a first position of a first participant and a second position of a second participant during a collaboration session;

calculating an average distance from each participant's position to a reference location in three-dimensions using a first height of the first participant and a second height of the second participant;

calculating a Center-of-Gravity (CoG) based, at least in part, upon the average distance; and outputting audio during the collaboration session with a sound volume determined based upon the CoG.

13. The method of claim 12, further comprising calculating an increase or decrease in the sound volume during at least a portion of the collaboration session in response to movement of the CoG.

14. The method of claim 12, wherein outputting the audio further comprises using a loudness table with acoustic calibration data.

15. The method of claim 12, further comprising identifying a first context of the first participant and a second context of the second participant, and calculating the average distance using weights associated with the first and second contexts, respectively.

16. A hardware memory device having program instructions stored thereon that, upon execution by a processor of an Information Handling System (IHS), cause the IHS to:

identify a first position of a first participant and a second position of a second participant during a collaboration session;

calculate an average distance from each participant's position to a reference location in three-dimensions using a first height of the first participant and a second height of the second participant;

calculate a Center-of-Gravity (CoG) based, at least in part, upon the average distance; and output audio during the collaboration session with a level determined based upon the CoG.

17. The hardware memory device of claim 16, wherein the program instructions, upon execution by the processor, further cause the IHS to:

receive a plurality of audio streams from a remote location;

determine that an audio stream contains speech by a third participant; and in response to a position of the third participant, adjust a level of the audio stream relative to other audio streams.

18. The hardware memory device of claim 16, wherein the program instructions, upon execution by the processor, further cause the IHS to:

receive a plurality of audio streams from a remote location;

determine that an audio stream contains speech by a third participant; and in response to a context of the third participant, adjust a level of the audio stream relative to other audio streams.

* * * * *